United States Patent [19]

Shannon

[11] 3,995,526

[45] Dec. 7, 1976

[54] METHOD FOR MANUFACTURING DETONATING FUSECORD

[75] Inventor: Gordon Brian Roger Shannon, Dundonald, Scotland

[73] Assignee: Imperial Chemical Industries Limited, London, England

[22] Filed: May 12, 1975

[21] Appl. No.: 576,573

[30] Foreign Application Priority Data

Dec. 23, 1974 United Kingdom ..... 55442/74

[52] U.S. Cl. ..... 86/22; 86/1 R; 102/27 R

[51] Int. Cl.[2] ..... F42B 3/10

[58] Field of Search ..... 102/27 R; 86/1 R, 20 R, 86/22; 149/7, 11, 93

[56] References Cited

UNITED STATES PATENTS

| | | | |
|---|---|---|---|
| 922,343 | 5/1909 | Schulman | 102/27 R X |
| 3,190,775 | 6/1965 | Ender | 149/7 X |
| 3,190,776 | 6/1965 | Ender | 149/7 X |
| 3,435,764 | 4/1969 | Kelly et al. | 102/27 R |
| 3,683,742 | 8/1972 | Rohde | 86/1 R |
| 3,773,572 | 11/1973 | Thomas | 102/27 R X |
| 3,908,509 | 9/1975 | Kelly et al. | 102/27 R |
| 3,908,549 | 9/1975 | Turner | 102/27 R X |

FOREIGN PATENTS OR APPLICATIONS

| | | | |
|---|---|---|---|
| 1,120,200 | 7/1968 | United Kingdom | 102/27 |

*Primary Examiner*—Harold Tudor
*Attorney, Agent, or Firm*—Cushman, Darby & Cushman

[57] ABSTRACT

Detonating fusecord having silicone oil applied to the transport tape surrounding the PETN explosive core, whereby the subsequent migration of the oil to the PETN improves the water resistance of the fusecord.

9 Claims, 1 Drawing Figure

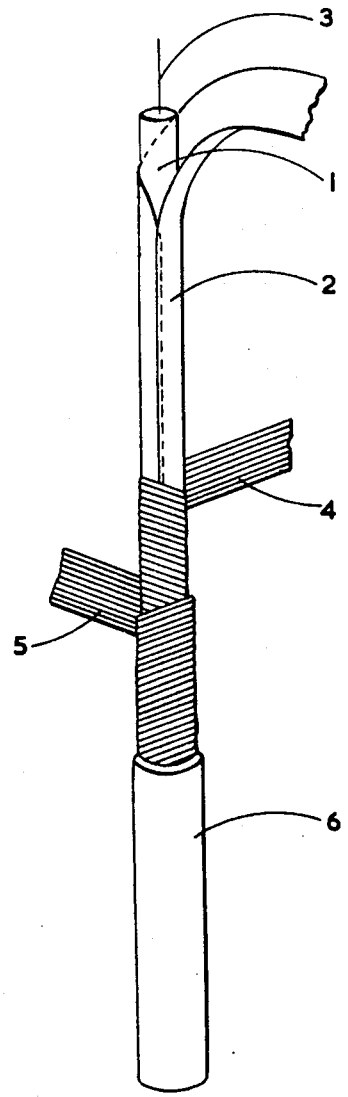
3
1
2
4
5
6

METHOD FOR MANUFACTURING DETONATING FUSECORD

This invention relates to detonating fusecord having a core of granular pentaerythritol tetranitrate (PETN) and to the manufacture of such fusecord. The invention is an improvement in or modification of the invention described and claimed in United Kingdom Patent Specification No. 1,355,234 in which PETN is treated with silicone oil to reduce its water permeability when used as the explosive core in detonating fusecord.

Detonating cord is widely used for detonation transmission lines for blasting and for generating seismic waves in land and marine seismographic prospecting. The construction and manufacture of one form of detonating cord is described in United Kingdom Patent Specification No. 1,120,200. Generally, the explosive core consists of compacted PETN encased in a thin paper or plastics tube reinforced with wrapping materials usually comprising one or more spun layers of textile yarns surrounded by a waterproof sheath of thermoplastics material. In the manufacture of cords of this construction, a longitudinal tape (known in the art as transport tape because it supports and conveys the PETN) is continually convoluted to form a thin tube by passing it through a die, PETN is continuously fed through the die into the tube thus formed and consolidated by passing the tube through compacting dies, textile yarns on bobbins rotating around the tube are continuously helically wound around the tube and the thermoplastics sheath is extruded around the yarns. In order to assist the flow of the PETN into the tube, one or more centre yarns are continuously drawn through the die as the detonating cord is formed and remains in the finished cord.

The explosive core of commercial detonating cord is readily desensitised by water and the cord cannot usually be initiated to detonation at an open end of the cord which has been immersed in water. This water desensitisation can be successfully counteracted by coating the PETN of the core with silicone, as described in the aforementioned Specification No. 1,355,234, the preferred method being to co-precipitate the PETN and silicone from a solution in acetone.

We have now found that the resistance to water desensitisation can be advantageously obtained by applying liquid silicone, hereinafter termed silicone oil, to the transport tape so that the silicone migrates from the tape to the PETN in the core of the detonating cord. Separate treatment of the PETN with silicone oil prior to the manufacture of the detonating cord is thereby avoided.

Thus, in accordance with this invention, in the manufacture of detonating cord wherein a thin transport tape is continuously convoluted to form a tube, PETN particles are continuously fed into the tube to form a consolidated core therein and the tube is reinforced with external wrapping materials, the transport tape is a tape coated with silicone oil on at least the part of its surface forming the interior surface of the tube. Preferably the transport tape is impregnated with silicone oil. The silicone oil subsequently migrates through the PETN and forms a coating thereon which is effective to increase the water resistance of the PETN core.

The tape may be suitably be, for example, paper or synthetic plastics material, such as polypropylene, and may conveniently be of a width appropriate to provide an overlap at the edges when convoluted to form the tube. It should obviously also be of sufficient strength to be continuously drawn through the die in the fusecord manufacturing apparatus without rupturing. The transport tape is conveniently treated with silicone oil by immersing a spool of tape in the oil and allowing the excess oil to drain off.

The silicone oil conveniently comprises polysiloxane containing units having the structure $R_xSiO_{(4-x/2)}$ wherein R is hydrogen or a monovalent hydrocarbon group, not more than one hydrogen atom being attached to any Si atom, and $x$ is 1 or 2. Preferably the silicone comprises a linear polysiloxane having the formula $(CH_3)_3Si\ [OSiR_2]_n\ OSi(CH_3)_3$ wherein R is hydrogen or alkyl and $n$ is an integer, or a cyclic polysiloxane having the formula $[SiR_2O]_n$ wherein R is hydrogen or alkyl and $n$ is an integer of 3 to 8.

Preferred linear polysiloxanes include trimethyl siloxy end-blocked polymethyl-hydrogen siloxane and trimethyl siloxy end-blocked polydimethyl siloxane and it is preferred that these polysiloxanes should contain on average 40 to 100 polysiloxane ($-SiR_2O$) units in their molecules.

Preferred cyclic polysiloxanes include, for example, cyclo-tetradimethyl siloxane and cyclo-tetramethylhydrogen siloxane.

Conveniently, the tube is reinforced by spinning textile reinforcing yarn around it and extruding a waterproof plastics sheath around the reinforcing yarn.

The invention also includes a detonating cord comprising a core of PETN encased in a thin transport tube coated at least on its interior surface and preferably impregnated with silicone oil.

The construction and manufacture of detonating cord in accordance with the invention is hereinafter described, by way of example only, with reference to the accompanying drawing showing diagrammatically a length of fusecord with one end dissected to illustrate the manufacturing sequence.

In the manufacture of the detonating cord a central core 1 of PETN is fed from a hopper exit into a silicon oil impregnated transport tape which is convoluted to form a thin tube 2. To ensure continuous flow from the hopper, a centre yarn 3 is trained through the hopper exit and along the axis of the tube 2. The tube 2 is surrounded by a spun layer of textile yarn 4 and a counterspun layer of textile yarn 5 and the layer 5 is coated with an extruded layer of thermoplastics material. The cord may be readily manufactured in the plant normally used for the manufacture of detonating cord. The silicone oil migrates from the tube 2 into the explosive in the core 1 soon after the cord is manufactured.

The following specific Examples further illustrate the practice of the invention.

EXAMPLE 1

In this Example, the transport tape was a machine glazed kraft paper tape 15.9 mm wide and 0.076 mm thick. It had been immersed in a silicone oil which was a trimethyl siloxy end-blocked polysiloxane having 15 dimethyl siloxane units and three methylhydrogen siloxane units per molecule, commercially available as Silicone Oil AS406 from Imperial Chemical Industries Limited.

The explosive core 1 was crystalline PETN containing a centre yarn 3 of 1000 denier polypropylene tape 3 mm wide and 0.08 mm thick having a twist of 80 turns per metre. The layers 4 consisted of eight yarns of the same polypropylene tape as centre yarn 3 (but without twist) wound at 26 turns per metre and the layer 5 consisted of 10 yarns of the same polypropylene tape as in layer 4 wound at 39 turns per metre. The sheath 6 was a polyvinyl chloride composition commercially available as 'Welvic' (Registered Trade Mark).

In a wet initiation test the open ends of sample lengths were immersed in water to a depth of 25 centimeters and tested at intervals for initiation by the side blow from a No. 6 ASA detonator (0.24 g PETN base charge) strapped to the end which had been immersed. The samples fired after 72 hours immersion whereas, in the same test with samples of a detonating cord identical to this Example but without the silicone oil, the PETN core became waterlogged and all failed after 5 hours immersion.

EXAMPLE 2

The detonating cord of this Example was the same as Example 1 except that the tube 2 was impregnated with a trimethyl siloxy end-blocked polydimethyl siloxane having about 90 dimethyl siloxane units per molecule, commercially available as silicone oil F111/20 from Imperial Chemical Industries Limited.

In the wet initiation test this Example gave the same results as Example 1.

EXAMPLE 3

The detonating cord of this Example was the same as Example 1 except that the tube 2 was impregnated with a trimethyl siloxy end-blocked polymethyl-hydrogen siloxane having about 50 methyl hydrogen siloxane units per molecule, commercially available as silicone oil DP42 from Imperial Chemical Industries Limited.

In the wet initiation test this Example gave the same results as Example 1.

EXAMPLE 4

The detonating cord of this Example was the same as Example 1 except that the transport tape was 1100 denier polypropylene tape 15.9 mm wide and 0.013 mm thick.

In the wet initiation test this Example gave the same results as Example 1.

What I claim is:

1. In a method of manufacturing detonating fusecord by steps which include forming a tube by continuously convoluting a thin transport tape and passing it through a die, and flowing particulate explosive material through the die into the tube, the improvement wherein the tape which is passed through the die is a tape precoated with silicone oil on at least that side which forms the interior surface of the tube before the tape contacts the explosive material whereby the silicone oil migrates from the tape to the surrounding explosive material in the completed cord.

2. A method as in claim 1 wherein the transport tape is impregnated with silicone oil.

3. A method as in claim 1 wherein the transport tape is made of paper.

4. A method as in claim 1 wherein the transport tape is made of plastics material.

5. A method as in claim 4 wherein the transport tape is made of polypropylene.

6. A method as in claim 1 wherein the transport tape is treated with silicone oil by immersing a spool of tape in the oil.

7. A method as claimed in claim 1 wherein the silicone oil comprises polysiloxane containing units having the construction $R_xSiO_{(4-x/2)}$ wherein R represents a member of the group consisting of hydrogen and monovalent hydrocarbon radicals, not more than one hydrogen atom being attached to any Si atom, and $x$ is 1 or 2.

8. A method as claimed in claim 7 wherein the silicone is selected from the group consisting of linear polysiloxanes having the formula $(CH_3)_3Si\ [OSiR_2]_n\ OSi(CH_3)_3$ wherein R represents a member of the group consisting of hydrogen and alkyl radicals and $n$ is an integer, cyclic polysiloxanes having the formula $[SiR_2]_n$ wherein R represents a member of the group consisting of hydrogen and alkyl radicals and $n$ is an integer of 3 to 8.

9. A method as claimed in claim 8 wherein the polysiloxane is selected from the group consisting of trimethyl siloxy end-blocked polymethyl-hydrogen siloxane, trimethyl siloxy end-blocked polydimethyl siloxane, cyclo-tetradimethyl siloxane and cyclo-tetramethylhydrogen siloxane.

* * * * *